United States Patent [19]

Kosuge et al.

[11] 4,357,965

[45] Nov. 9, 1982

[54] METHOD AND APPARATUS FOR GATHERING A RING SHAPED WIRE ROD

[75] Inventors: Yasuo Kosuge, Kimitsu; Masamori Yakabe, Kisarazu; Tadanori Ōga, Kisarazu; Tōru Maeda, Kisarazu, all of Japan

[73] Assignee: Nippon Steel Corporation, Tokyo, Japan

[21] Appl. No.: 138,917

[22] Filed: Apr. 10, 1980

[30] Foreign Application Priority Data

Apr. 13, 1979 [JP] Japan ..... 54/45034

[51] Int. Cl.[3] ..... B21F 3/04

[52] U.S. Cl. ..... 140/2

[58] Field of Search ..... 140/2, 71 C, 88, 102, 140/102.5, 92.8; 242/79, 81, 82, 83

[56] References Cited

U.S. PATENT DOCUMENTS

| | | | |
|---|---|---|---|
| 3,603,355 | 9/1971 | Geipel et al. | 140/2 |
| 3,618,871 | 11/1971 | Gilvar | 242/81 |
| 3,756,289 | 9/1973 | Rotert et al. | 140/2 |
| 3,770,025 | 11/1973 | Hirschfelder et al. | 140/2 |

FOREIGN PATENT DOCUMENTS

| | | | |
|---|---|---|---|
| 1904750 | 8/1970 | Fed. Rep. of Germany | 140/2 |
| 130002 | 3/1978 | German Democratic Rep. | 242/83 |
| 54-153963 | 4/1979 | Japan | 242/79 |

*Primary Examiner*—John McQuade

*Attorney, Agent, or Firm*—Cushman, Darby & Cushman

[57] ABSTRACT

In a method for gathering a ring shaped wire rod, particularly a wire rod made of steel, the wire rod is continuously conveyed and gathered in the form of a coil by means of a gathering apparatus including a gathering tub and a coil plate. In accordance with the present invention, the lowering speed of the coil plate is controlled in such a manner that piling position of said rings is always within a predetermined range. In addition, the ring shaped wire rod is dropped, while imparting a movement having a horizontal component to the ring shaped wire rod so as to increase the filling ratio over that of the prior art. The coils gathered in the present invention are more compact than in the prior art.

2 Claims, 17 Drawing Figures

PRIOR ART

METHOD AND APPARATUS FOR GATHERING A RING SHAPED WIRE ROD

The present invention relates to a method and apparatus for gathering a ring shaped wire rod.

In the production of a wire rod coil, the wire rod is dropped into a gathering device, such as a gathering tub, in which each ring of the wire rod, which is spirally wound, is gathered together in the form of a coil. The wire rod may be spirally wound while being conveyed from a conveyor to the gathering tub.

The term wire rod used herein means a metallic material which is finish-rolled in a wire rod rolling mill.

The term ring shaped wire rod used herein means a long finish-rolled metallic material, particularly a steel material, wound in a spiral form but not yet gathered in the form of a coil. One ring shaped wire rod, therefore, has a number of ring shaped portions.

In a conventional method of gathering a ring shaped wire rod, which is illustrated in FIG. 1, a wire rod 1 leaving a finishing rolling mill 2 is water-cooled by a cooling device 3, successively formed into the form of rings via a looping device 4, transferred by a conveyor 5 and gathered by dropping the ring shaped wire rod into a gathering tub 6. Illustrated more in detail in FIGS. 2A and 2B is the ring shaped wire rod 1. The ring shaped wire rod is gathered in the form of a coil 8 which is concentric with a sail 7, as illustrated in FIG. 2B. Since the gathering is conducted in the conventional method by dropping the ring shaped wire rod 1 into the gathering tub 6, due to the conveying force of the conveyor, the rings are sometimes entangled by the sail 7 and the entangled portions of the coil protrude into the inside of the coil. When the coil of the wire rod is later bundled by means of a hoop guide of a bundling machine, the bundling operation is hindered, because the hoop guide strikes against the inwardly protruding entangled portions of the coil. In addition, when the rings are entangled by the sail as mentioned above, the filling ratio of the rings of the coil gathered in the gathering tub 6 is decreased, so that the height of the coil is larger and the thickness thereof is thinner than a coil having high filling ratio. Furthermore, the bundled coil having a low filling ratio may collapse. When the coil is strongly bundled by a bundling machine to prevent its collapse, the coil may be buckled or flaws may be formed on the wire rod. In addition, the unit cost of a bundling material, such as a bundling hoop, used per low filling ratio coil is disadvantageously high due to the large height of the coil. Furthermore, the efficiency of transporting the coils and storing the coils in a warehouse or in a ship is disadvantageously low, because the weight relative to the space occupied by the coils is low when the filling ratio is low.

It is an object of the present invention to eliminate the disadvantages of the conventional method and to provide a method for gathering a ring shaped wire rod, which method is capable of enhancing the filling ratio of the rings in a coil, so that the height and thickness of a coil is lower and thicker, respectively, than those of the coil gathered by the conventional method.

It is another object of the present invention to provide a gathering apparatus for carrying out the method mentioned above.

In a method for gathering the ring shaped wire rod, wherein the ring shaped wire rod is continuously conveyed and gathered in the form of a coil, an improvement according to the present invention which comprises controlling the lowering speed of a coil plate for carrying the ring shaped wire rod in such a manner that the piling position of the ring shaped wire rod, which drop from a conveying device onto the coil plate in a gathering tub, is always within a predetermined range, and further, dropping the ring shaped wire rod onto the coil plate while imparting a movement having a horizontal component to the ring shaped wire rod above the piling position.

The ring shaped wire rod may be displaced, according to the present invention, at axially symmetrical positions of the gathering tub. In order to impart a movement having a horizontal component to the ring shaped wire rod, usually levers are advanced into and retracted from the gathering tub. The sequence in which of the levers are advanced and retracted can be optionally selected in accordance with the desired gathering states of the ring shaped wire rod. In a gathering state in which the rings of a coil are shifted axial-symmetrically around the axis of the gathering tub and are offset in a radial direction from the axis of the gathering tub, the levers are successively advanced and retracted in the order in which they are arranged around the gathering tub. In another gathering state in which the rings of a coil are offset from the axis of the gathering tub in a predetermined direction, not all but several of the levers are advanced and retracted in a predetermined sequence. Usually, the advancing and retracting movement of the levers is realized in such a manner that the levers are successively moved in the order in which they are arranged around the gathering tub. The number of rings dropping after the displacement by the levers should be from 1 to 10, desirably from 2 to 6. The frequency of the lever engagement with the ring shaped wire rod may be such that each ring is displaced by any one of the levers at a predetermined position above the piling position, or that one or several rings are not displaced and a succeeding ring is displaced by any one of the levers.

An apparatus according to the present invention is characterized by: a means for controlling the lowering speed of a coil plate, so as to always pile the ring shaped wire rod within a predetermined range, and; at least one means for engaging the ring shaped wire rod above the piling position, which engaging means imparts a movement having a horizontal component to the ring shaped wire rod.

The controlling means of the lowering speed may consist of an optical device for detecting the piling position of the ring shaped wire rod and a means for driving the coil plate, said driving means being operably connected to the optical detecting device. The engaging means for imparting a movement having a horizontal component to the ring shaped wire rod may be positioned stationarily with respect to the gathering tub, and a movable engaging portion of this means may be advanced to and retracted from an engaging position with the ring shaped wire rod. The speed of the advancing and retracting movement of the movable portion mentioned above is advantageously controlled, by an electric motor for driving the movable portion in accordance with the lowering speed of the ring shaped wire rod. The levers mentioned above are located preferably at four positions around the gathering tub. However, the position and number of the levers can be optionally selected depending upon the gathering states of the ring shaped wire. As the engaging means for displacing the ring shaped wire rod, levers, which are swingable and retractable from the gathering tub, can be used in the present invention. However, the engaging means is not restricted to such levers, but may be a cylindrical body having an upwardly enlarging taper at the inner surface thereof. When such a cylindrical body is used in the present invention, the cylindrical body is eccentrically rotated around the center of a sail, i.e. the center of the gathering tub in a horizontal plane, and the ring shaped wire rod is dropped on the inner surface of the rotated cylindrical body and then passes through the hollow part of the cylindrical body. A system other than the levers and the cylindrical body can be used, as long as the ring shaped wire rod can be displaced while it is dropping.

According to the method and apparatus of the present invention, the ring shaped wire rod is seldom entangled by the sail. Accordingly, problems related to the bundling of the coils gathered according to the present invention in a bundling machine are considerably decreased as compared with the conventional gathering. In addition, the filling ratio of the rings of the coil is high, and therefore, the height and thickness of the coil are low and thick, respectively. Accordingly, with the present invention it is possible to considerably decrease the number of times collapse of coils occurs as compared with the conventional gathering. Furthermore, the bundling force required for preventing the collapse of the coils is not so strong as to cause buckling of the coil. Contrary to this, in the coils gathered by the conventional method, buckling occurs and flaws may be formed on the wire rods due to the use of a bundling force which is strong enough to prevent the collapse of the coils. Furthermore, the unit cost of the bundling material, the coil-transporting efficiency in a ships and a coil-storing efficiency in a warehouse are improved in the present invention over the conventional gathering.

The present invention will now be explained in detail with reference to preferable embodiments illustrated in FIGS. 3 through 9.

BRIEF DESCRIPTION OF THE DRAWINGS

In the drawings:

Referring to FIG. 3, a ring shaped wire rod 1 is continuously conveyed by a conveyor 5 and is then dropped from the terminal portion of the conveyor into a gathering tub 6. The ring shaped wire rod 1 is piled on a coil plate 20 around a sail 7 which is liftable. The piled rings are axially symmetrical with respect to the sail 7. In accordance with the present invention, the piling is carried out as follows.

Figure 1:
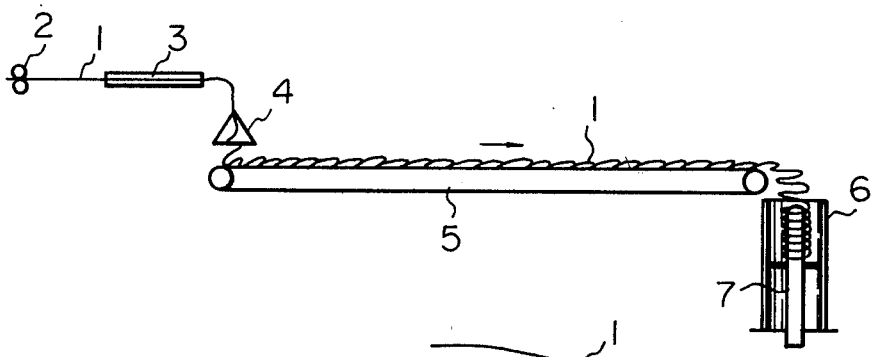
Fig. 1 PRIOR ART
FIG. 1 schematically illustrates a conventional method of gathering a ring shaped wire rod.
Figure 2A:
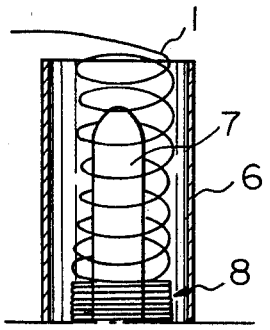
Fig. 2A PRIOR ART
FIG. 2A is a schematic cross-sectional view of the essential parts of a conventional gathering apparatus.
Figure 2B:
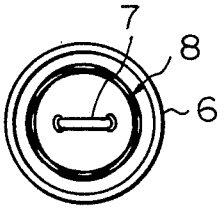
FIG. 2B is a plan view of a ring shaped wire rod gathered by a conventional method.
Figure 3:
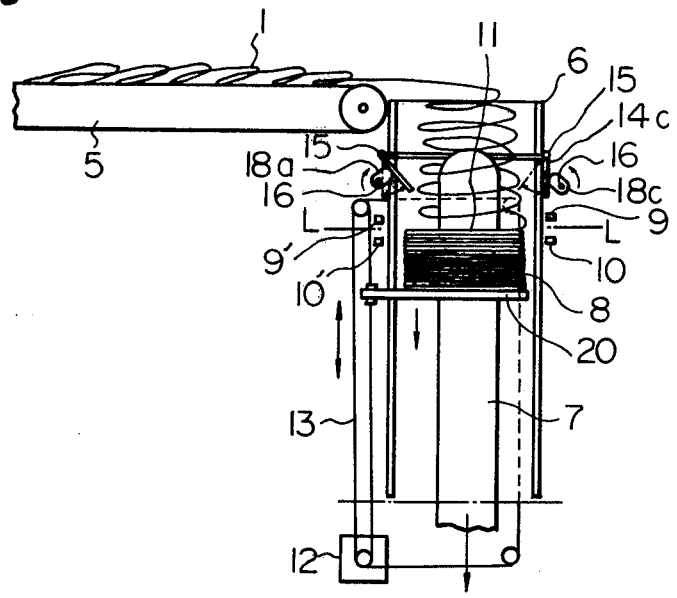
FIG. 3 is a front view of a gathering apparatus.

The number of dropped rings dropping number and dropping speed of the rings per unit time are preliminarily determined from the relationship between the finish-rolling speed of the wire rod and the speed of the conveyor 5 in the method of the present invention. From the dropping number and dropping speed of the rings, the piling speed of the ring shaped wire rod on the coil plate 20 is determined. A motor 12 for elevating and lowering the coil plate 20 is connected via a chain 13 to the coil plate 20 and is driven in accordance with the piling speed. The motor 12 can be usually controlled so that the piling position of the ring shaped wire rod with respect to the vertical position of the gathering tub 6 is constant for all of the rings. When the coil plate 20 is lowered in accordance with the piling speed, determined as stated above, it is usually possible to maintain the piling position of the ring shaped wire rod constant. The piling speed can also be caused to vary for reasons other than the variance in the finish-rolling speed and speed of the conveyor. Optical detecting devices 9, 9' and 10, 10' are disposed above and below the theoretical piling position L—L, and are spaced from the theoretical piling position L—L a predetermined equal distance as illustrated in FIG. 3. When the upper surface 11 of the piled ring shaped wire rod is higher than the level of the optical detecting devices 9, 9', the lowering speed of the coil plate 20 is increased, so that the upper surface 11 is always below the optical detecting devices 9, 9'. On the other hand, when the upper surface 11 is lower than the level of the optical detecting devices 10, 10', the lowering speed of the coil plate 20 is decreased, so that the upper surface is always above the optical detecting devices 10, 10'. The largest range of piling position, namely the distance between the optical detecting devices 9, 9' and 10, 10' is approximately 100 mm, preferably from 30 to 40 mm. The upper surface of the piled ring shaped wire rod should always be positioned at the theoretical piling position L—L.

Figure 4:
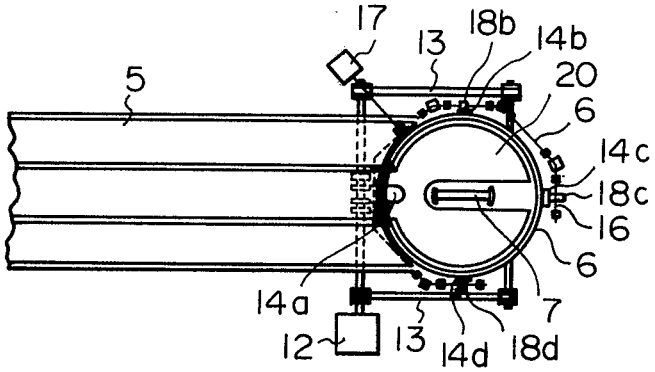
FIG. 4 is a plan view of the apparatus illustrated in FIG. 3.

Referring to FIGS. 3 and 4, levers **14*a*, 14*b*, 14*c* and 14*d* are located at four positions around the gathering tub 6 above the theoretical piling position L—L of the ring shaped wire rod. The levers 14 are fixed to the gathering tub 6 by a pin 15 at the upper part of the levers and are swingable around the pin 15. Cams 18*a*, 18*b*, 18*c*, and 18*d* are swung around a shaft 16 by a motor 17 and cause the levers to be advanced into and restracted from the gathering tub 6. The sequence of the advancing and retracting movement of the levers is, for example, 14*a*, 14*b*, 14*c* and 14*d*. As a result of the movement of the levers 14, the ring shaped wire rod 1 being dropped is piled on the piling position as illustrated in FIG. 3 while being displaced by the swinging movement of the levers 14. The rings of the coil are, therefore, symmetrically shifted around the sail 7. As will be apparent from the explanation with reference to FIGS. 3 and 4, the movement of the ring shaped wire rod is realized by the levers having a horizontal component of movement, and this movement causes the ring shaped wire rod 1 being piled to displace outwardly away from the sail 7 (the center of the movement), i.e. toward the wall of the gathering tub 6. The advancing and retracting speed of the levers 14*a*, 14*b*, 14*c* and 14*d* is controlled by the rotating number of the motor 17 in accordance with the dropping speed of the ring shaped wire rod 1. Namely, the advancing and retracting speed is high or low, when the dropping speed is high or low, respectively. The engaging position of the levers 14 with the ring shaped wire rod is between the top end of the sail 7** and the theoretical piling position L—L. The number of the rings being dropped after the engagement with the levers is two to six.

Figure 5:
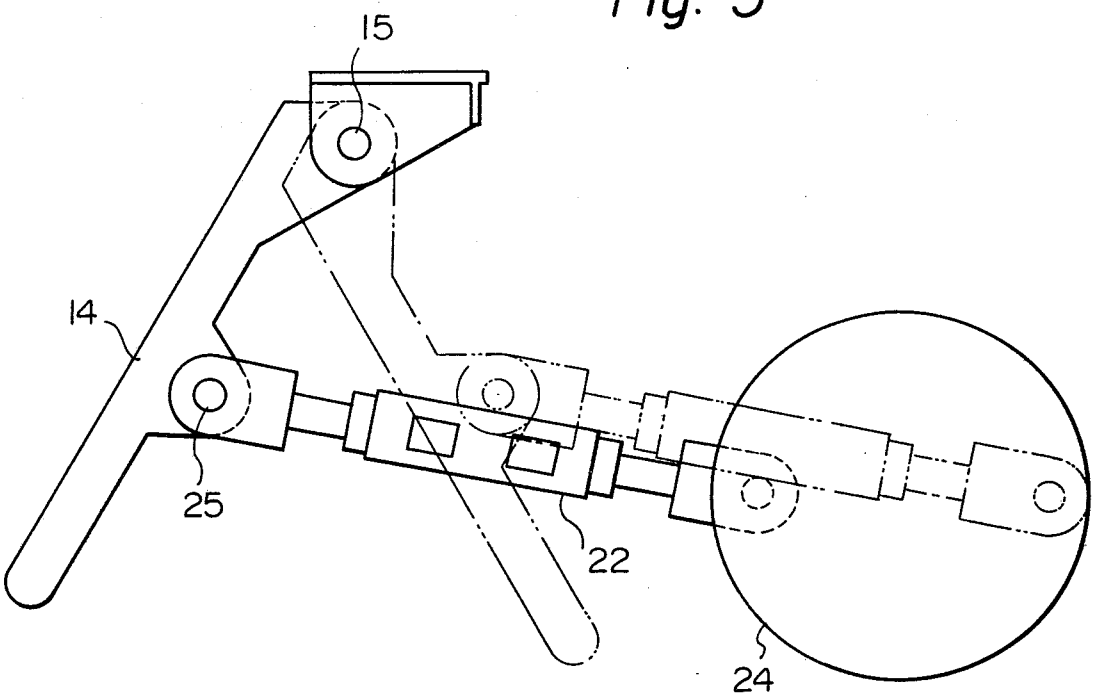
FIG. 5 is a view of an engaging means for a horizontal displacement.

In an engaging means for imparting a movement having a horizontal component to the ring shaped wire rod illustrated in FIG. 5, the levers 14 are operably connected to a disc 24 rotating at a given speed via a coupling 25 and a hydraulic cylinder 22. The frequency of engagement of the levers 14 with the ring shaped wire rod is determined by the rotating speed of the disc 24.

Figure 6A:
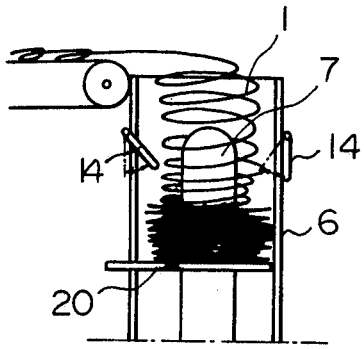
FIGS. 6A and 6B are front and plan views illustrating the gathered rings of a ring shaped wire rod, respectively.
Figure 6B:
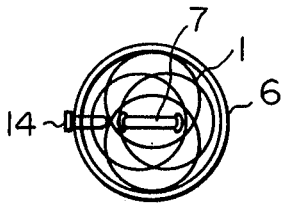
Figure 7:
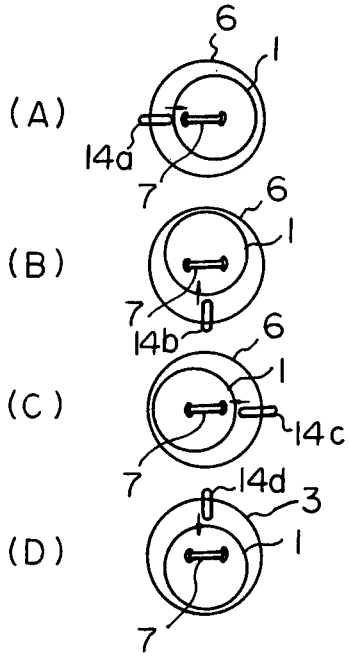
FIGS. 7A, 7B, 7C and 7D illustrate an advancing and retracting sequence of the levers.
Figure 8:
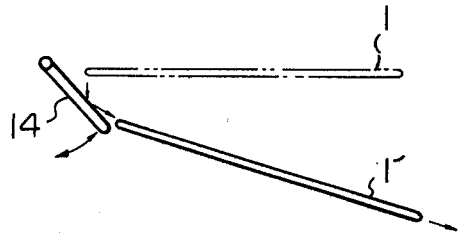
FIG. 8 is a schematic drawing illustrating the ring shaped wire rod being displaced during dropping.

The displacement of the ring shaped wire rod will now be explained in more detail with reference to FIGS. 6, 7 and 8. The ring shaped wire rod 1 is dropped into the gathering tub 6 from above and strikes against the levers 14. The ring shaped wire rod 1 is, therefore, moved from the position shown by a two dot chain line in FIG. 8 to the position shown by a solid line while it is dropping. A forcible driving movement may be imparted by the swinging of the levers 14 so as to displace the ring shaped wire rod 1. The levers 14*a*, 14*b*, 14*c* and 14*d* are located at four positions around the gathering tub 6 as illustrated in FIGS. 7A through 7D, and are successively advanced and retracted in the order as illustrated in FIGS. 7A, 7B, 7C and 7D, with the result that each ring of the coil is axially shifted away from the axis of the sail 7. The rings so shifted or dispersed are piled as illustrated in FIG. 6B in the form of a coil and the center of each ring is radially displaced from the center of the sail 7. A desired dispersion condition of the rings can be easily obtained by changing the rotating number of the motor 17 (FIG. 4).

Figure 9:
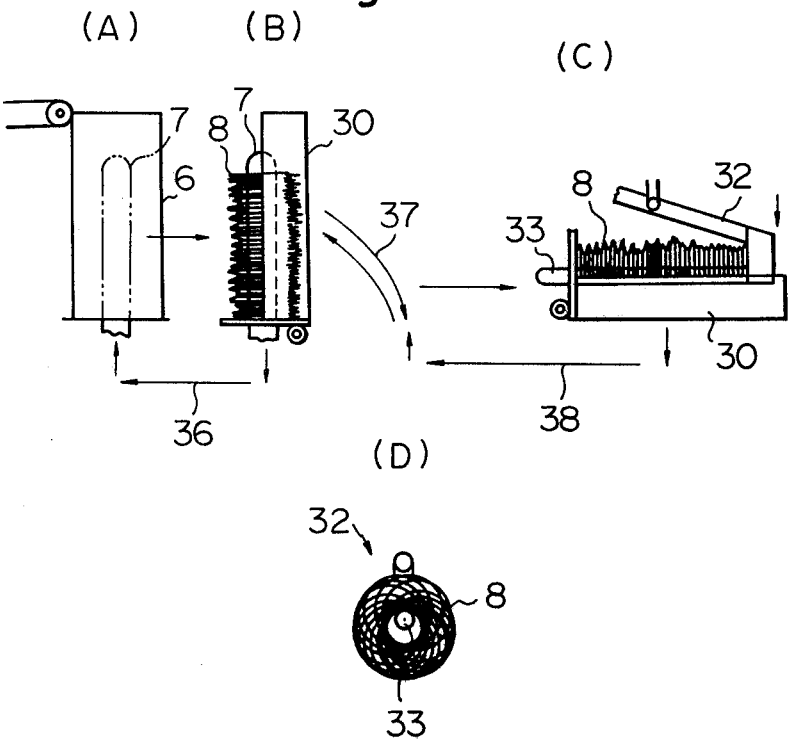
FIGS. 9A, 9B, 9C and 9D are drawings illustrating steps of bundling a coil.

Processes after the gathering of a ring shaped wire rod until hanging it on a hanger, for example, a C hook, are illustrated in FIG. 9. After the completion of the gathering of a ring shaped wire rod, the coil 8 is transferred from the interior of the gathering tub 6 to a down ender 30 by horizontally moving the sail 7 through an opened door part (not shown) of the gathering tub 6 (from FIGS. 9A to 9B). When the coil 8 is accommodated in the down ender 30, the sail 7 is lowered and, then horizontally moved toward the gathering tub 6. The movement of the sail is illustrated by arrows 36. After the horizontal movement, the sail 7 is lifted, so that the sail 7 is in the original position as illustrated in FIG. 9A. The coil 8 accommodated in the down ender 30 is tilted as shown by an arrow 37 in FIG. 9B, so that the coil is in a horizontal position. The coil in the horizontal position is transferred toward a hanger 32 illustrated in FIG. 9C and the so transferred coil 8 is loaded on a bar 33 of the hanger 32. When the coil 8 is loaded on the hanger 32, the down ender 30 is lowered, and thereafter, rises and returns to the original position as illustrated in FIG. 9B. The coil 8 loaded on the hanger 32 is conveyed as illustrated in FIG. 9D via an inspection process to a bundling machine (not shown). The transferring, lowering, rising and returning movements of the down ender are illustrated by the arrows 38.

We claim:

1. In a method for gathering a ring shaped wire rod, wherein the ring shaped wire rod is continuously conveyed, dropped from a conveying device onto a coil plate, for carrying said ring shaped wire rod, in a gathering tub, and gathered in the form of a coil, the improvement which comprises: (1) controlling the lowering speed of said coil plate, which is vertically displaceable in said gathering tub, by optically detecting the piling position of the ring shaped wire and thereby adjusting the coil plate in accordance with the detecting of the piling position in a manner such that the piling position of said rings of the ring shaped wire rod is always within a predetermined range, and further, (2) engaging and dropping said ring shaped wire rod, while imparting a movement having a horizontal component to said ring shaped wire rod above said piling position, by advancing and retracting a plurality of levers arranged symmetrically around a sail of the gathering tub whereby the rings of said ring shaped wire rod are radially displaced from the center of a sail in a manner such that the shape of said coil is symmetric around its center.

2. An apparatus for gathering a ring shaped wire rod in the form of a coil, comprising:

a gathering tub for receiving a ring shaped wire rod dropping from above;

a coil plate for piling thereon said ring shaped wire rod dropping in said gathering tub, said coil plate vertically displaceable in said gathering tub;

means for controlling the lowering speed of said coil plate consisting of an optical device for detecting the piling position of said ring shaped wire rod and means for driving said coil plate which is operably connected to said optical device thereby maintaining the piling position of said ring shaped wire rod within a predetermined range; and at least one means for engaging said ring shaped wire rod above said piling position, said engaging means being fixed to said gathering tub and having a plurality of levers arranged around said gathering tub at symmetrical positions around a sail of said gathering tub and adapted for advancing into and retracting from the engaged position with said ring shaped wire rod thereby imparting a movement having a horizontal component to said ring shaped wire rod.

* * * * *